United States Patent [19]

Heine et al.

[11] 4,090,054

[45] May 16, 1978

[54] ELECTRICAL PREHEATING APPARATUS

[75] Inventors: Hans Gunther Heine, Little Silver; Otto Hochstrasser, North Brunswick, both of N.J.

[73] Assignee: Brown Boveri Corporation, North Brunswick, N.J.

[21] Appl. No.: 731,748

[22] Filed: Oct. 12, 1976

[51] Int. Cl.[2] ..... H05B 5/00

[52] U.S. Cl. ..... 219/10.49 R; 13/25; 13/26; 219/10.75; 219/421; 219/426; 219/437; 219/438; 219/523; 266/240

[58] Field of Search ..... 219/10.49, 10.57, 10.75, 219/421, 426, 427, 437, 438, 521, 523, 553, 385; 13/20, 21, 22, 25, 26, 29, 31; 266/240; 323/56; 338/330

[56] References Cited

U.S. PATENT DOCUMENTS

| | | | |
|---|---|---|---|
| 1,680,718 | 8/1928 | Abbott | 219/421 |
| 2,851,579 | 9/1958 | Pfeiffer | 219/427 |
| 2,876,324 | 3/1959 | Longacre | 219/10.49 |
| 2,898,430 | 8/1959 | Brueder | 219/10.49 |
| 3,293,412 | 12/1966 | Profitt et al. | 219/421 |
| 3,343,074 | 9/1967 | Brock | 323/56 |
| 3,397,375 | 8/1968 | Casper et al. | 13/25 X |
| 3,502,847 | 3/1970 | Heide | 219/426 |
| 3,656,910 | 4/1972 | Ferment | 219/10.49 X |
| 3,688,007 | 8/1972 | McKenna et al. | 13/20 |
| 3,737,153 | 6/1973 | Steffora et al. | 266/240 |
| 3,895,174 | 7/1975 | Jung | 13/21 |
| 4,017,701 | 4/1977 | Millelmann | 219/10.49 |

FOREIGN PATENT DOCUMENTS

| | | | |
|---|---|---|---|
| 965,835 | 6/1957 | Germany | 219/421 |

OTHER PUBLICATIONS

Brown Boveri Technical Data Sheets EQ 252, "Graphite-rod rocking furnaces" (undated), 3 pp.

Cesiwid brochure "Cesiwid-Graphite Heating Elements up to 3000° C", Cesiwid Electrowarme GmbH, (undated), 14 pp.

Cesiwid publication "High Temperature Heating Elements" Cesiwid Electrowarme GmbH, (undated), 4 pp.

Maxon Corporation Bulletin 2300-2373 (1973 Edition), "Premix Blower-Mixers", USA, pp.2301-2302.

Industrial catalog pp. 30, 38, 44, 46, 51 and 52, "Ladles" (undated).

North American Mfg. Co., Bulletin 46.96(5-61), "Gas--Compressed Air Torches", 3-1961, 2 pp.

R. D. Gray; "New Holding Furnace Uses Resistance Heatings", Foundry M & T, Jul. 1975, pp. 65, 66, 68, 69 and 72.

*Primary Examiner*—Volodymyr Y. Mayewsky

*Attorney, Agent, or Firm*—Fitzpatrick, Cella, Harper & Scinto

[57] ABSTRACT

A preheating arrangement for bringing foundry ladles up to temperature is described. The arrangement comprises a slotted elongated graphite rod extending down from a ladle cover, a pair of clamp and contact elements extending through the cover and a transformer above the cover with a shell around the transformer forming a single turn secondary winding connected directly to the clamp and contact elements. A graphite element is coated to protect it from corrosive atmospheres by heating it, while buried in sand, to the fusing temperature of the sand and then allowing it to cool.

8 Claims, 14 Drawing Figures

Fig. 1.
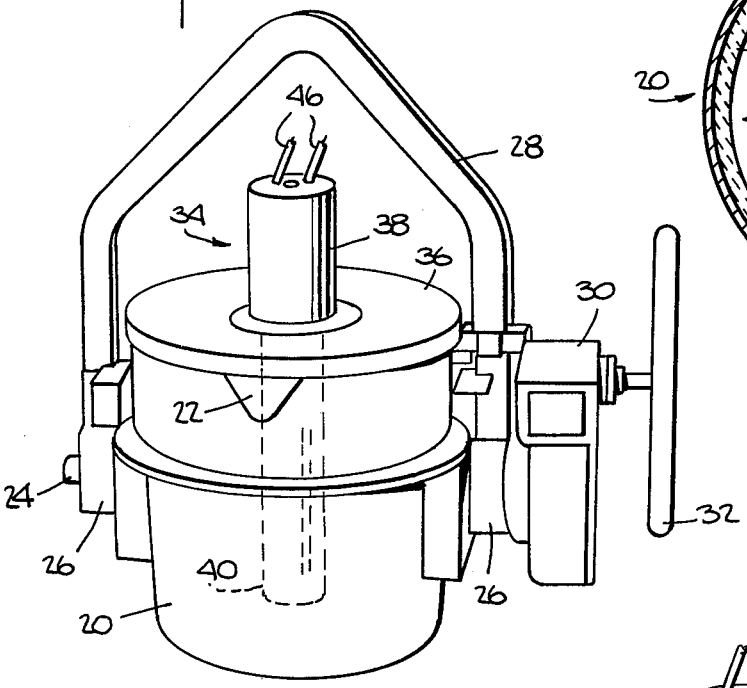
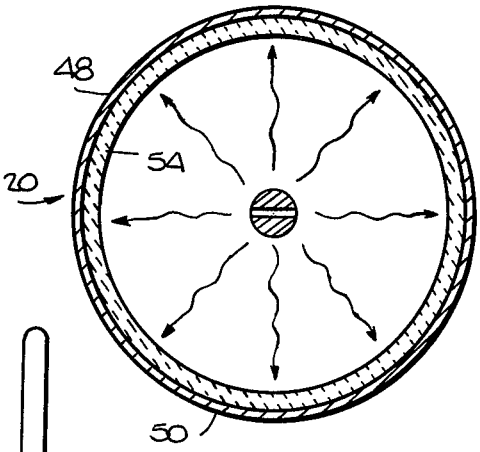
Fig. 4.
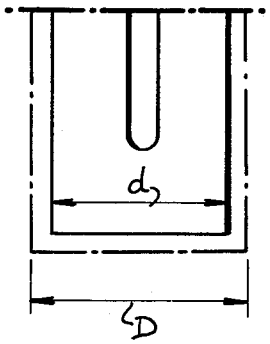
Fig. 6.
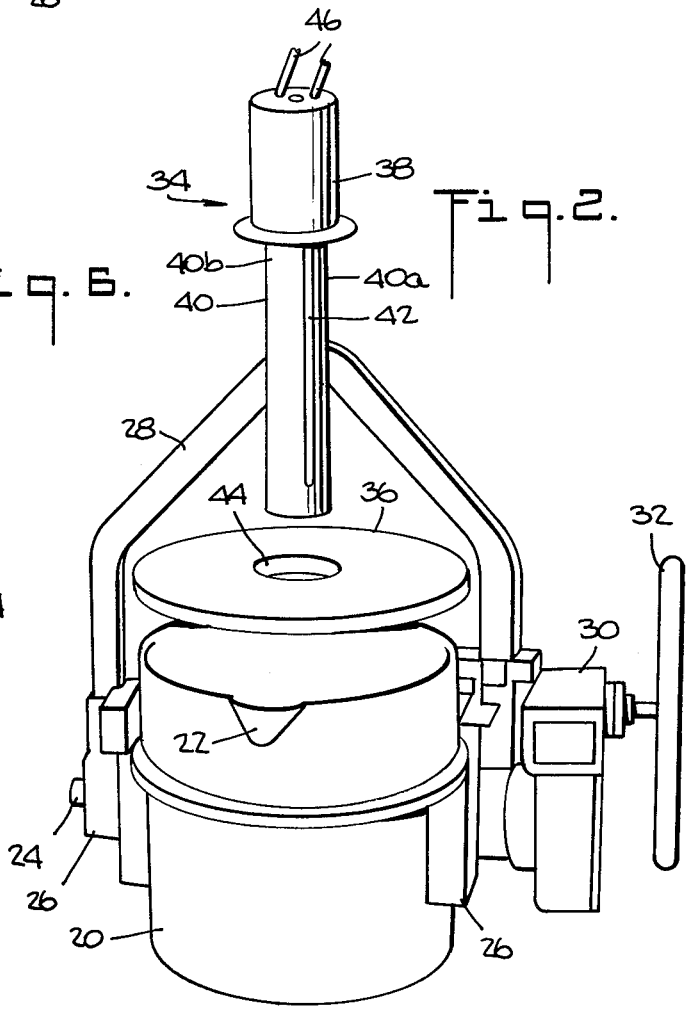
Fig. 2.
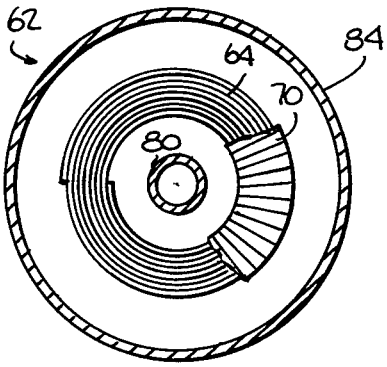
Fig. 5.

ELECTRICAL PREHEATING APPARATUS

BACKGROUND OF THE INVENTION

1. Field of the Invention

This invention relates to high temperature heating and more particularly it concerns novel and improved electrical resistance heating arrangements characterized by low cost and reliable long duration operation.

2. Description of the Prior Art

The present invention is especially useful in connection with ladle preheating in metal foundries. In foundry operations molten metal is carried in a bucket-like ceramic lined ladle and is poured from this ladle into molds where it cools and solidifies to a particular configuration. Before a ladle can receive molten metal, however, it must first be preheated to a temperature of for example 1200° C, otherwise its ceramic lining will crack as a result of thermal stress when molten metal at e.g. 1400°–1600° C is poured into it. Even the preheating of the ladle must not be done too rapidly or the thermal stresses encountered in the preheating operation itself will cause the ladle lining to crack. In general, several hours are required for bringing a ladle up to temperature in a safe manner.

In the past, foundry ladles were preheated by special gas or oil fired burners whose flame was directed down into the center of the ladle. The hot flaming gases from the burner would blow back up along the inner sidewalls of the ladle to heat them; and then the gases would escape out through the top opening of the ladle. This technique of directing a burner flame down into a ladle had the advantage of providing an even distribution of applied heat to the ladle walls but it was wasteful of energy since hot gases were continuously emitted out from inside the ladle. This excessive use of heat energy was especially aggravated due to the fact that it is usually necessary to maintain at least one spare preheated ladle at operating temperature at all times during foundry operations.

Electrical resistance type heaters have previously been employed for melting of metal or for maintaining molten metal in its liquid state. Examples of such heaters are seen in U.S Pat. No. 3,737,153 and in German Pat. No. 965,835. These electrical resistance heaters, which operate by directing a high amperage electrical current through a graphite element, have not been suitable for ladle preheating because the graphite element would deteriorate relatively rapidly at the high temperatures and oxidizing atomspheres encountered in the preheating operation.

SUMMARY OF THE INVENTION

The present invention overcomes the above described difficulties of the prior art and permits ladles to be preheated at a safe rate and held at operational temperatures for long periods of time without undue loss of energy. Moreover, the present invention permits ladles and similar vessels to be heated to very high temperatures by graphite electrical resistance elements without significantly high rates of electrode deterioration.

According to one aspect of this invention, there is provided a novel method of preheating a ladle comprising the steps of covering the top of the ladle to prevent removal of gases into and out from it. While the ladle is so covered a high magnitude electrical current is passed through a graphite bar extending down inside the ladle. This high current causes the bar to become heated to a temperature at which the oxygen inside the ladle combines with graphite material from the bar. Thereafter, electrical current continues to flow through the bar; however, the bar does not deteriorate further due to the fact that the top of the ladle retains the inert gases around the graphite bar.

According to a further aspect of the invention, there is provided a novel ladle preheating arrangement comprising a ladle cover which is configured to extend across the top of a ladle to provide a closure for confining gases within the ladle. An electrical transformer is mounted on the top or outside of the cover and a heating element clamping device is also mounted on the cover adjacent the transformer to extend down through the cover. The heating element clamping device comprises a pair of mutually opposed electrically conducting clamp members which are electrically insulated from each other and which are connected, respectively, to a different output lead of the transformer. The clamp members are resiliently biased toward each other. There is also provided an electrical resistance heating element comprising a bar of graphite material having a slot extending down from an upper end to a location near to but removed from its lower end so that the bar is divided into two spaced apart parallel elements integrally connected at their said other end. An electrically insulative spacer is positioned between the elements at their upper end and the upper ends of the elements are in contact with and are pinched against the spacer by associated ones of the clamp members. As a result of this construction the cover serves to support the heating element to extend down inside the ladle with its electrical power supply immediately adjacent the heating element outside the cover while at the same time the cover serves to contain within the ladle the hot inert gases formed therein by operation of the heating element.

During initial operation of the heating element the oxygen trapped inside the ladle by the cover causes a small but finite amount of heating element erosion. However, the heating element is in the form of a graphite bar with substantial cross sectional dimensions and therefore before the bar can erode by an amount sufficient to affect its electrical performance, the oxygen content within the ladle will have been depleted and the atmosphere in the ladle is thus rendered inert so that further erosion of the heating element cannot occur.

According to another aspect of this invention there is provided a novel heating element assembly comprising a graphite bar having a longitudinal slot extending from its upper end down to a location near its lower end to divide the bar into a pair of parallel closely spaced elements integrally connected at the lower end of the bar. There is also provided a step down transformer having a single turn secondary coil formed in the shape of a shell surrounding the transformer core and primary windings. The ends of this shell are connected, respectively, to two electrically conductive clamping members and means are provided to press these members toward each other with the upper ends of the graphite heating element between them. An electrically insulative spacer member is positioned between the upper ends of the graphite elements to keep them from touching each other when they are clamped by the clamping members. This arrangement permits the delivery of a very high amperage current to the graphite heating element with a minimum of electrical transmission loss since the transformer secondary, which produces the high amperage current, is directly connected to the clamping members.

According to a still further aspect of the present invention, there is provided a novel electrical resistance heating element comprising an elongated bar of graphite material having terminal ends for connection to a source of high magnitude electrical current. The bar of graphite material is coated between its terminal ends with a glazing of an air impermeable material transparent to infra-red radiation. This glazing, which is preferably of silica, allows heat to be radiated from the graphite heating element and at the same time it prevents oxygen or other corrosive gases from reacting with and eroding the graphite at high temperatures.

According to the present invention, there is provided a novel method of forming a high temperature electrical resistance heating element capable of withstanding corrosive atmospheres. This method involves the steps of embedding a graphite bar in a volume of sand and then, while the bar is so embedded, passing a high magnitude electrical current through the bar to raise its temperature above the fusing temperature of the surrounding sand. Then, when the sand surrounding the bar has been fused to a predetermined thickness the electrical current flow through the bar is reduced so that the fused sand hardens about the bar as an air impermeable glazing thereon which is transparent to infra-red radiation from the bar.

There has thus been outlined rather broadly the more important features of the invention in order that the detailed description thereof that follows may be better understood, and in order that the present contribution in the art may be better appreciated. There are, of course, additional features of the invention that will be described more fully hereinafter. Those skilled in the art will appreciate that the conception on which this disclosure is based may readily be utilized as the basis for the designing of other arrangements for carrying out the several purposes of the invention. It is important, therefore, that this disclosure be regarded as including such equivalent arrangements as do not depart from the spirit and scope of the invention.

BRIEF DESCRIPTION OF THE DRAWINGS

Certain embodiments of the invention have been chosen for purposes of illustration and description and are shown in the accompanying drawings forming a part of this specification, wherein:

FIG. 1 is a perspective view of a ladle fitted out for preheating with a preheating assembly according to the present invention;

FIG. 2 is a perspective view similar to FIG. 1 but exploded to show the arrangement of elements comprising the preheating assembly;

FIG. 4 is a reduced size cross section view taken along line 4—4 of FIG. 3;

FIG. 5 is a cross section view taken along line 5—5 of FIG. 3;

FIG. 6 is a diagrammatic representation of a fragmentary portion of the preheating assembly of FIG. 1 for illustrating how the invention operates according to one of its aspects;

DETAILED DESCRIPTION OF THE PREFERRED EMBODIMENTS

Figure 3:
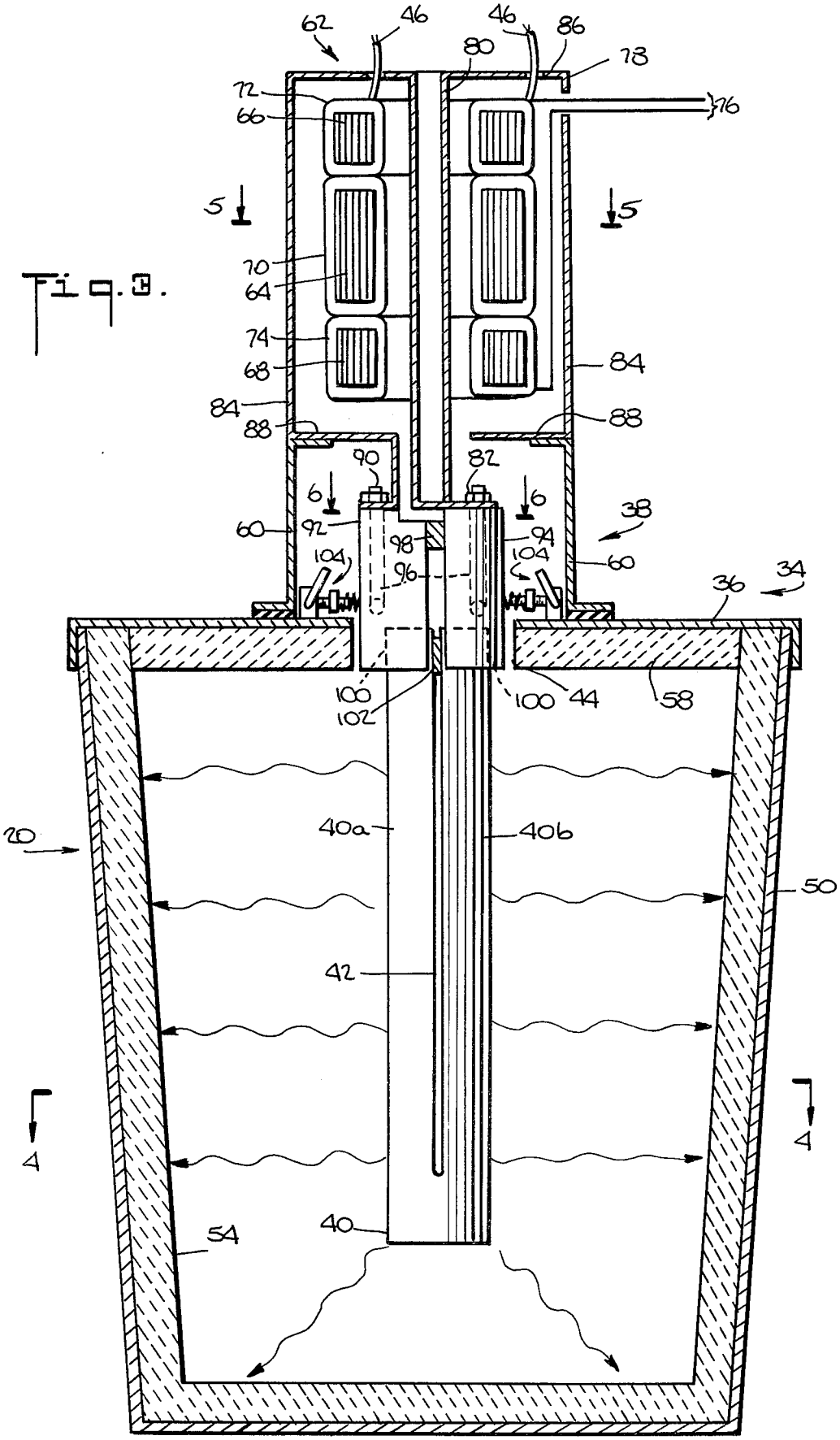
FIG. 3 is an enlarged elevational section view showing the interior of the ladle and preheating assembly of FIG. 1.

The ladle shown in FIG. 1 comprises a bucket-like bowl 20 of generally cylindrical configuration and closed at the bottom thereof. An outwardly protruding pouring spout 22 is formed along the top of the bowl for pouring molten metal when the bowl is tipped.

The bowl 20 is provided with outwardly projecting trunnions 24 extending outwardly from diametrically opposed locations on each side of the bowl equidistant from the pouring spout 22. These trunnions ride in bearings 26, which in turn are supported on the ends of an inverted V-shaped bail 28. A crane hook or equivalent means (not shown) may be engaged under the apex of the bail 28 to lift and transport the ladle, for example, between a melting furnace anda pouring location.

A gear box 30 is mounted on one side of the bail 28 and this gear box interconnects one of the trunnions 24 with a pouring wheel 32. By turning the pouring wheel the ladle may be tipped about the trunnions 24 so that molten metal in the ladle can be poured out through the spout 22.

As shown in FIG. 1 the ladle is also provided with a preheater assembly 34 which remains with the empty ladle while it is slowly brought up to operating temperature and then held at operating temperature prior to being brought into service. The preheater assembly 34 comprises a cover 36, configured to fit across the top of the ladle, a transformer and clamp assembly 38 mounted on the upper side of the cover and a heating element 40 extending down from the central region of the cover and into the ladle bowl 20. As can be seen in FIG. 2 the heating element 40 comprises a bar of graphite formed with a longitudinal slot 42 extending down from its upper end to a location close to but removed from its lower end so that there are formed two closely spaced parallel elements **40*a* and 40*b* integrally connected at their lower ends. The upper ends of the elements 40*a* and 40*b* are connected directly to the transformer and clamp assembly 38 which in turn projects down through a central opening 44 in the cover 36. Alternating current electrical power is supplied to the transformer and clamp assembly 38 from an external source (not shown) through a pair of input leads 46**.

The ladle interior and the construction of the preheater assembly are best seen in FIGS. 3–7. As shown in FIGS. 3 and 4 the bowl 20 of the ladle comprises an outer shell 48 of heavy steel and is formed with a generally cylindrical side wall 50, which is somewhate wider at its upper end than at its lower end, and a bottom wall 52. A liner 54 of ceramic or the like extends over the interior of the side and bottom walls 50 and 52 to insulate the outer steel shell 48 from the high temperature of molten metal carried in the ladle. The ceramic liner 54 may have a thickness of from 5 to 10 centimeters depending upon the size of the ladle and the temperature of the molten metal.

Because of the high heat insulation characteristics of the ceramic liner 54 different local regions thereof are maintained at different temperatures and accordingly these different regions are subjected to different degrees of thermal expansion. If these localized temperature differences are imposed on the liner too suddenly it will experience excessive thermal stress and will crack or break apart. The preheater assembly 34 serves to bring the ladle interior, including the liner 54, up to temperature at a slow rate prior to the introduction of molten metal into it so as to prevent the concentration of thermal stresses when the ladle is put into use.

As shown in FIG. 3 the cover 36 is also formed of heavy steel and it is provided with a ceramic liner 58 along its under surface. The cover 36 is configured to fit closely over the top of the bowl 20 so as to prevent flow of gases either into or out from the ladle interior. The transformer and clamp assembly 38 is mounted on the upper side of the cover 36 by means of a bracket 60. A toroidal type variable reactance transformer 62, for example of the kind described in U.S. Pat. No. 3,343,074, is mounted on the bracket 60. This transfomer comprises a central main core 64 of coiled iron strip and upper and lower auxiliary cores 66 and 68 also of coiled iron strip. The input leads 46 are connected to a primary coil 70 wound toroidally around the main core 64, as shown in FIG. 5. A pair of serially connected direct current control windings 72 and 74 are also wound toroidally around the upper and lower auxiliary cores 66 and 68. These control windings receive direct current via input control leads 76 from a control source (not shown). By controlling the current flow through the windings 72 and 74, the auxiliary cores 66 and 68 will exert various magnetic influence on the main core 64 to control the current output of the transformer.

The transformer 62 is provided with an outer toroidal shaped shell 78 of heavy copper or highly conductive copper alloy; and this outer shell forms a single turn transformer secondary winding extending around all three cores 64, 66 and 68. The shell 78 includes a tubular central portion 80 which extends down inside the cores and terminates at a first output terminal 82. The shell 78 also includes a tubular outer portion 84 which extends down around the outside of the cores. The inner and outer portions 80 and 84 are connected at their upper ends by a washer shaped member 86. A similar washer shaped member 88 extends inwardly from the lower end of the outer portion 84 and terminates at a second output terminal 90.

The transformer output terminals 82 and 90 are connected, respectively, to the upper ends of a pair of clamping members or contact heads 92 and 94. These contact heads extend down through the central opening 44 in the cover and engage the upper ends of the parallel elements 40*a* and 40*b* of the graphite electrical resistance heating element 40. The contact heads 92 and 94, as shown in FIGS. 3 and 6, are of copper or highly conductive copper alloy and they are formed with internal passageways 96 through which cooling water flows from an external source (not shown). An electrically insulative upper spacer 98 is positioned between the contact heads 92 and 94 to prevent them from contacting each other and short circuiting the system. Each of the contact heads 92 and 94 is provided with a recess 100 for closely accommodating the upper end of one of the parallel elements 40*a* and 40*b* of the electrical resistance heating element 40. An electrically insulative lower spacer 102 is positioned between the upper ends of the heating element 40 to prevent them from contacting each other. A pair of releasable spring pressure mechanisms 104 are mounted on the cover adjacent the contact heads 92 and 94 and may be actuated to force the heads toward each other to pinch the heating element upper ends and the upper and lower insulative spacers between them. In this way the heating element 40 is clamped in position to extend down centrally inside the ladle as shown in FIGS. 3 and 4. At the same time the secondary or output of the transformer 62 is closely connected, via the terminals 82 and 90 to the clamping or contact heads 92 and 94 and from there to the upper ends 40*a* and 40*b* of the heating element 40.

In operation, the preheating assembly 34 is positioned on the ladle with the cover 36 extending over the upper end of the ladle bowl 20 and the graphite heating element 40 projecting axially down inside the bowl 20 of the ladle as shown in FIGS. 3 and 4. Electrical power is then supplied to the transformer 62 via its input lead 46. This power, which for example may be at 440 volts and in the neighborhood of 90 amperes, is stepped down in the transformer 62 to 13 volts and approximately 3000 amperes; and the resulting high current is passed through the graphite electrical resistance heating element 40 flowing down one of its parallel elements and back up the other. This continuous flow of high current causes the heating element to reach temperatures of as much as 3000° C. The actual temperature achieved depends upon the amount of current flowing through the heating element 40; and this, of course, can be adjusted by adjusting the amount of direct current supplied to the control windings 72 and 74 of the transformer 62.

As can be seen in FIGS. 3 and 4 the heat produced by the graphite heating element 40 is evenly distributed along its entire surface and is radiated directly outwardly therefrom in all directions. Consequently, the entire inner surfaces of the ladle receive an even application of heat so that thermal stresses within the ladle are minimized. By adjusting the current through a transformer control windings 72 and 74, the temperature of the heating element 40 can be gradually increased so that the ladle is brought up to operating temperature at a very controlled rate.

Figure 7:
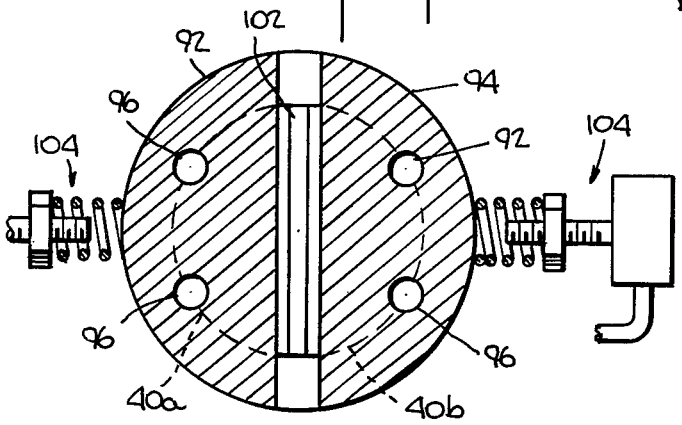
FIG. 7 is a cross section view taken along line 7—7 of FIG. 3.

In the past, graphite electrical resistance heating elements had very limited application due to the fact that they deteriorated rapidly at high temperatures in all but very inert atmospheric conditions. With the present invention, however, the deterioration of the heating element 40 is minimized due to the fact that it has a substantial cross section (e.g. 7.5 centimeters or more) and by the fact that the preheating assembly is constructed to prevent the flow of gases into or out from the ladle during the heating process. As heating begins, the oxygen present in the air within the ladle will combine with the graphite material along the surface of the heating element 40; and this will cause a small degree of erosion and reduction of the cross-sectional dimension of the heating element as illustrated in exaggerated manner in FIG. 7. Thus, as shown, the diameter of the heating element, as indicated in FIG. 7, is reduced from an initial value "D" to an operating value "*d*". However, before the diameter "*d*" is made small enough to have any appreciable effect upon the effective electrical resistance or heat generating capability of the heating element the free oxygen within the ladle will have been consumed and the remaining atmosphere in the ladle will have been rendered essentially inert. Consequently, further erosion of the heating element will not take place and the heating element can be operated continuously within the ladle for long periods of time. The cover 36, as indicated previously, prevents movement of gases into or out from the ladle so that the inert atmosphere within the ladle formed by the graphite heating element itself will remain essentially inert.

It will also be noted that the transformer 62, having its outer shell 78 formed as a single turn winding, provides a high current power supply which is directly connected to the clamping members or contact heads 92 and 94. In this manner high magnitude electrical currents of up to 3,000 amperes can be passed through the graphite heating element 40 with a minimum of losses. Also, the provision of the water cooled clamping or contact heads 92 and 94 would project through the opening 44 of the cover 36 allows the transformer to be effectively insulated from the high temperature radiation produced by the heating element 40 within the ladle.

Figure 8:
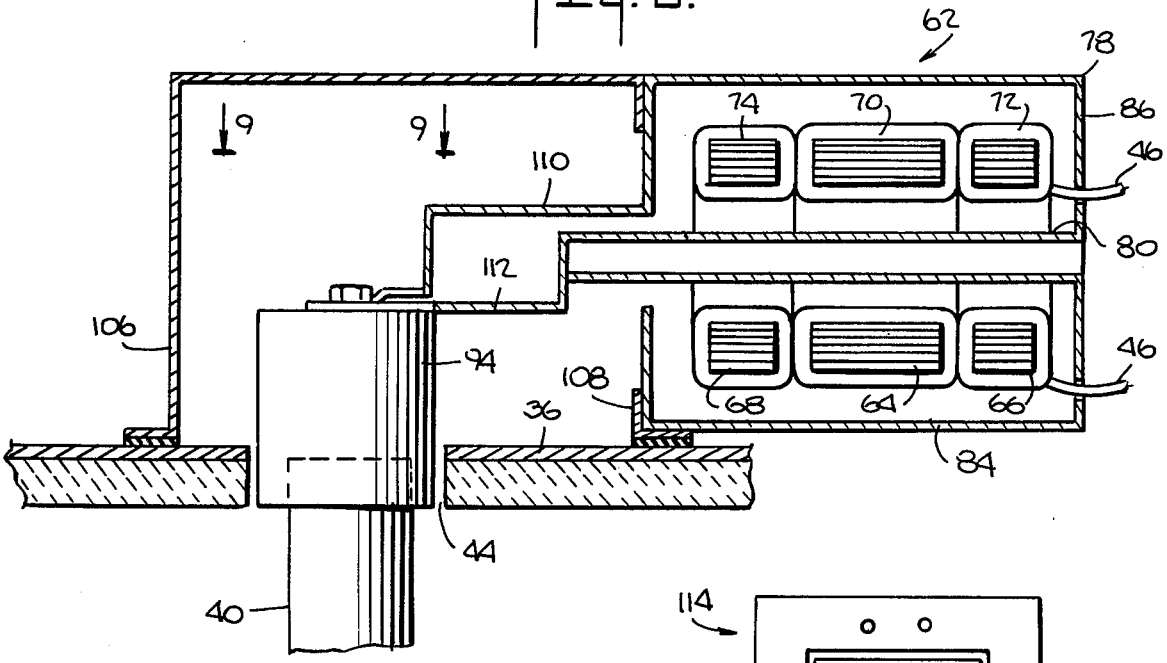
FIG. 8 is a fragmentary view, taken in section, showning a modified arrangement of the preheating assembly components in accordance with the present invention.
Figure 9:
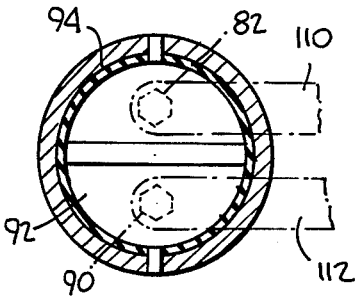
FIG. 9 is a view taken along line 9—9 of FIG. 8.

FIGS. 8 and 9 show a modification which permits rapid and convenient removal of the clamping members or contact heads 92 and 94 along with the graphite heating element 40 for replacement of the heating element. As can be seen in FIG. 8 the transformer 62 is mounted on the cover 36 out of alignment with, but adjacent to, the central opening 44 in the cover. Transformer bracket elements 106 and 108 are provided on the cover to support the transformer on its side. Buss-like leads 110 and 112 extend from the central and outer portions 80 and 84, respectively, of the transformer shell 78 to the output terminals 82 and 90 for connection to the clamping members or contacting heads 92 and 94. With this arrangement the transformer may be disconnected from the clamping means or contact heads 92 and 94 and these heads may be withdrawn along with the heating element 40 without the necessity of removing the transformer itself.

Figure 10:
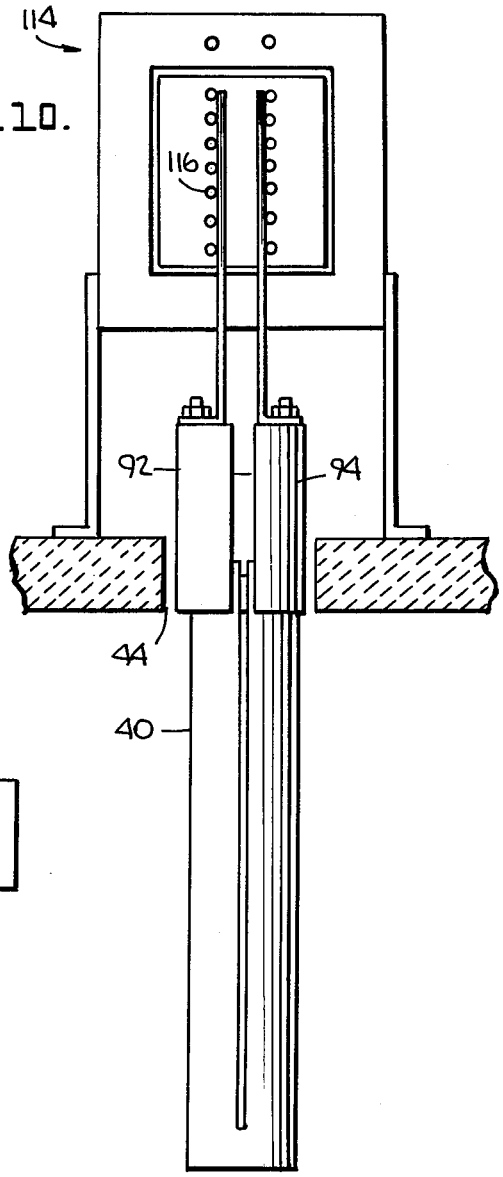
FIG. 10 is a fragmentary view, taken in section, showing a further modified arrangement of the preheating assembly components in accordance with the present invenion.

FIG. 10 shows a further modification in which a conventional shell type transformer 114 is mounted on the cover 36 in place of the toroidal transformer of the preceding embodiments. The shell-type transformer may be preferred for some applications since it is more economical to fabricate. However, the shell-type transformer has somewhat less flexibility in control. It will be noted that the shell-type transformer 114 also has effectively a single turn secondary coil 116 which is connected directly to the terminals 82 and 90 on the clamping or contact heads 92 and 94.

Figure 11:
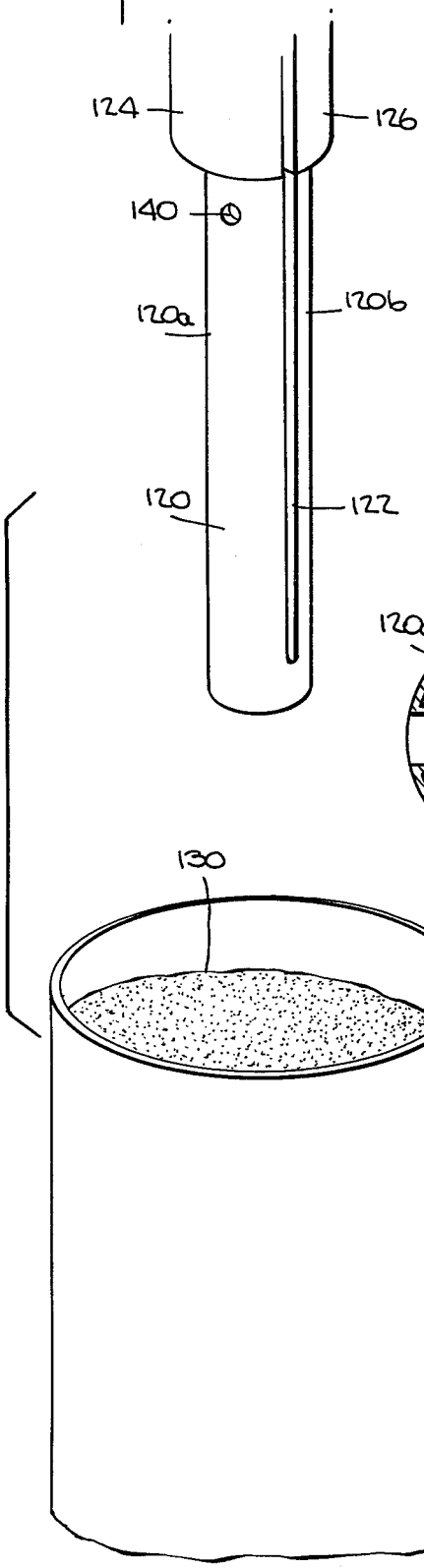
FIG. 11 is a perspective view illustrating a first step in carrying out a resistance heater element coating technique in accordance with a second aspect of the present invention.

FIGS. 11–14 illustrate a further aspect of the present invention according to which there is formed an electrical resistance heating element of graphite material and having a protective coating which retards deterioration due to operation of the heating element in oxygen containing or corrosive atmospheres. As shown in FIG. 11 a heating element 120 is formed of a bar of graphite material and is slotted longitudinally as illustrated at 122 from the top thereof down to a location near the bottom so as to divide the bar into two parallel elements **120*a* and 120*b* integrally connected at their lower ends. The upper ends of the elements 120*a* and 120*b* are clamped in a manner similar to that described above by means of clamping or contact heads 124 and 126**. These clamping or contacting heads are provided with suitable electrical power supply arrangements as described above.

Figure 12:
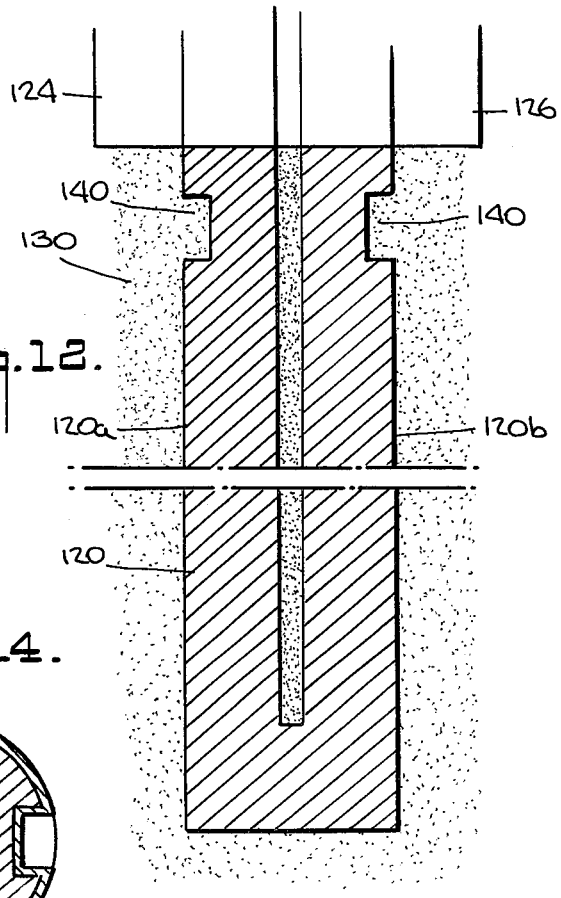
FIG. 12 is a fragmentary cross section view illustrating a second step in carrying out a resistance heater element coating technique in accordance with said second aspect of the present invention.
Figure 13:
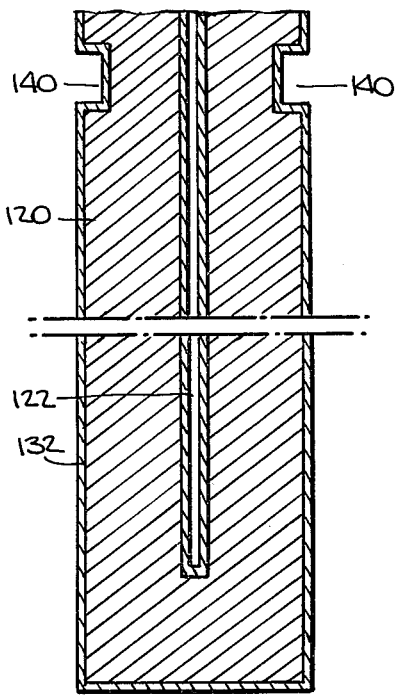
FIG. 13 is a further fragmentary cross section view illustrating a final step in carrying out a resistance heater element coating technique in accordance with said second aspect of the present invention.

As shown in FIG. 11 there is provided a container 128 filled with a volume of sand 130. The graphite heating element 120 is embedded in this volume of sand as illustrated in FIG. 12 so that all of its surfaces are covered by the sand. At this point electrical current is passed through the heating element 120 and the current magnitude is adjusted to bring the heating element temperature up past the fusing temperature of the sand, i.e. 1900° C. This temperature is maintained while the sand immediately adjacent the surfaces of the graphite heating element begins to melt and fuses. When this fusing extends out from the surface of the heating element 120 by a predetermined amount (e.g. 5 millimeters) the electrical current through the heating element 120 is reduced. This allows the fused sand to resolidify as a glaze which, as shown in FIG. 13, forms a glazed coating 132 over the surfaces of the heating element 120. This coating, being of substantially pure silica, is highly transparent to infra-red radiation and, therefore, it does not interfere appreciably with heat transmission from the heating element 120. On the other hand, the glazed coating is essentially impermeable to air or other gases and therefore it acts as a protective covering which minimizes or eliminates erosion of the heating element during operation at high temperatures even in corrosive or oxygen bearing atmospheres.

It will be appreciated that the thus coated heating element 120 is used only at temperatures which do not exceed the remelting temperature of the silica coating.

Figure 14:
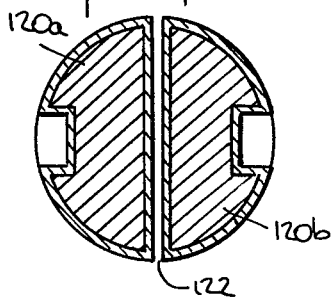
FIG. 14 is a cross section view taken along line 14—14 of FIG. 13.

The graphite heating element 120 undergoes a greater degree of contraction upon cooling than does the silica coating which has been formed on it as described above. Accordingly, the graphite material, upon cooling, will shrink and pull away, to a certain degree, from the coating. In order to ensure against the coating slipping off from the heating element, especially where the slotted region 122 did not receive a substantial amount of coating, there may be provided near the upper end of the heating element 120 a pair of indentations 140 as shown in FIG. 11. The glazed coating will extend into these indentations as shown in FIGS. 13 and 14 and thereby provide an interlock to hold the coating onto the heating element.

It will be appreciated from the foregoing that the graphite electrical resistance heating element can be rendered highly resistant to the corrosive effects of oxygen and other atmospheres in an easily carried out manner according to this invention.

Having thus described the invention with particular reference to the preferred form thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by letters patent is:

1. Apparatus for use in preheating a ladle, said apparatus comprising a transformer having a single turn secondary winding formed as the outer shell of the transformer, said winding having a pair of closely spaced output terminals, a pair of clamping and contact heads attached, respectively, to said outer shell at said output terminals, an elongated graphite bar having an elongated slot extending from one end toward, but short of, the other end thereof to divide the bar into a pair of closely spaced parallel elements integrally connected together at said other end, an electrically insulative spacer between said elements at said one end of said bar, said elements at said one end of said bar being positioned between and contacted by said clamping and contact elements and means associated with said clamping and contact elements for forcing them toward each other to clamp said one end of said bar between them.

2. Apparatus according to claim 1 wherein said transformer is of the toroidal type having annular cores and wherein said outer shell includes an inner tubular portion extending through the interior of said cores and an outer tubular portion surrounding said cores, said inner and outer portions being connected together at one end by a washer shaped conductive member and being formed at their other end with output terminals.

3. Apparatus for preheating a ladle in which molten metal is to be contained, said apparatus comprising in combination a cover configured to extend across the top of said ladle and to provide a closure for confining gases inside the ladle, an electrical transformer mounted on the outside surface of said cover, a heating element clamping device also mounted on said cover adjacent said transformer and extending down through the cover, said heating element clamping device comprising a pair of mutually opposed electrically conductive clamp and contact members electrically insulated from each other and each connected, respectively, to a different output terminal of said transformer, and means for urging said clamp members toward each other, an electrical resistance heating element comprising an elongated bar of graphite material having a slot extending down from an upper end thereof to a location close to but removed from the lower end of said bar, said slot dividing the bar into two closely spaced parallel elements integrally connected at said lower end, an electrically insulative spacer positioned between said elements at their upper end and the upper end of said elements being in contact with associated ones of said clamp members which in turn pinch said upper ends of said element against said spacer, whereby said cover serves to support said heating element to extend down inside a ladle with its electrical power supply immediately adjacent the heating element outside the cover while at the same time said cover contains within said ladle the hot inert gases formed by operation of said heating element.

4. Apparatus according to claim 3 wherein said transformer has a single turn outer winding forming a shell surrounding said transformer and wherein said clamp and contact members are attached to different terminal points on said shell.

5. Apparatus according to claim 3 wherein said transformer is of the toroidal type and is provided with control windings to vary its secondary current output.

6. Apparatus according to claim 3 wherein said transformer is laterally displaced on said cover with respect to said clamp and contact members to permit their removal from the cover while said transformer remains in place.

7. Apparatus according to claim 3 wherein said transformer is of the shell type.

8. Apparatus according to claim 3 wherein said clamp and contact members extend through an opening in said cover, and wherein said clamp and contact members are liquid cooled.

* * * * *